US009804562B2

(12) United States Patent
Arata

(10) Patent No.: US 9,804,562 B2
(45) Date of Patent: Oct. 31, 2017

(54) IMAGE FORMING APPARATUS INCLUDING DUCT MEMBER FOR COOLING

(71) Applicant: KYOCERA Document Solutions Inc., Osaka-shi, Osaka (JP)

(72) Inventor: Tatsuro Arata, Osaka (JP)

(73) Assignee: KYOCERA Document Solutions Inc., Osaka-shi, Osaka (JP)

( * ) Notice: Subject to any disclaimer, the term of this patent is extended or adjusted under 35 U.S.C. 154(b) by 0 days.

(21) Appl. No.: 15/269,623

(22) Filed: Sep. 19, 2016

(65) Prior Publication Data

US 2017/0090416 A1 Mar. 30, 2017

(30) Foreign Application Priority Data

Sep. 30, 2015 (JP) ..... 2015-194319

(51) Int. Cl.
*G03G 21/20* (2006.01)
*G03G 21/16* (2006.01)

(52) U.S. Cl.
CPC ..... *G03G 21/206* (2013.01); *G03G 21/1619* (2013.01); *G03G 2215/0132* (2013.01)

(58) Field of Classification Search
CPC ..... G03G 15/1619; G03G 21/206; G03G 2215/0132
See application file for complete search history.

(56) References Cited

U.S. PATENT DOCUMENTS

2004/0228646 A1* 11/2004 Sekiguchi ..... G03G 21/206 399/92

FOREIGN PATENT DOCUMENTS

JP 2000098858 A 4/2000

* cited by examiner

*Primary Examiner* — Hoang Ngo
(74) *Attorney, Agent, or Firm* — Alleman Hall Creasman & Tuttle LLP

(57) ABSTRACT

An image forming apparatus includes a housing, a duct member, and a board. The housing has a support plate extending in a vertical direction. The duct member is attached to the support plate and has a first air duct through which air sent by a blower passes. The board has an element that is mounted thereon and generates heat when energized, and has a part supported by the duct member so as to cover an outer surface of the first air duct.

13 Claims, 11 Drawing Sheets

IMAGE FORMING APPARATUS INCLUDING DUCT MEMBER FOR COOLING

INCORPORATION BY REFERENCE

This application is based upon and claims the benefit of priority from the corresponding Japanese Patent Application No. 2015-194319 filed on Sep. 30, 2015, the entire contents of which are incorporated herein by reference.

BACKGROUND

The present disclosure relates to an image forming apparatus including an air duct that forms a channel for air to cool an internal device.

An image forming apparatus which forms an image on a sheet member, such as a copy machine and a printer, is known. Within such a type of image forming apparatus, various members that become heat sources are provided. Examples of such members include a heating device for melting toner, and a motor for driving a roller or the like. Due to these heat sources, the temperature within the image forming apparatus increases. The increase in the temperature within the image forming apparatus causes, for example, a decrease in the flowability of a developer such as toner, a decrease in an electric charge amount of the developer, or a variation in a sheet conveyance speed due to expansion of a roller, resulting in an image defect. Thus, hitherto, in the image forming apparatus, a cooling device for sending air to the interior of the image forming apparatus to cool the interior is provided. The conventional cooling device includes an air duct for passing air blown from an air blower, and the air is sent from the air duct toward an object to be cooled, thereby cooling the object.

In addition, the conventional image forming apparatus includes a control board, a power supply board, and the like. The control board has electronic devices such as a CPU to control the image forming apparatus, and the like, mounted thereon, and the power supply board has a power module such as a converter, a transformer, and a transistor, mounted thereon, and each board generates heat when supplied with power. These boards are typically fitted to a support plate provided in the image forming apparatus.

SUMMARY

An image forming apparatus according to one aspect of the present disclosure includes a housing, a duct member, and a board. The housing has a support plate extending in a vertical direction. The duct member is attached to the support plate and has a first air duct through which air sent by a blower passes. The board has an element that is mounted thereon and generates heat when energized, and has a part supported by the duct member so as to cover an outer surface of the first air duct.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
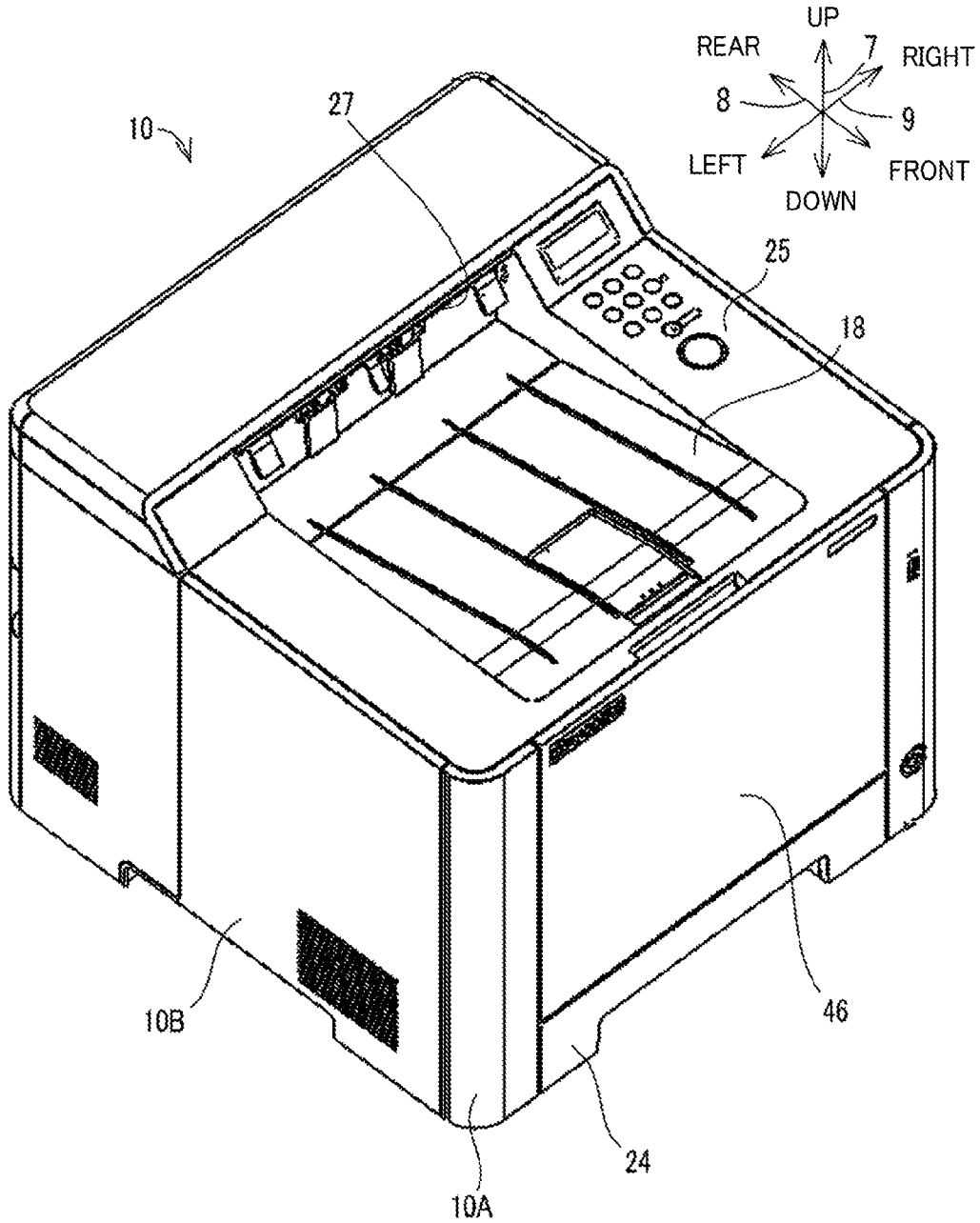
FIG. 1 is a left side perspective view illustrating the structure of an image forming apparatus according to an embodiment of the present disclosure.

Hereinafter, embodiments of the present disclosure will be described with reference to the accompanying drawings as appropriate. It should be noted that the embodiments described below are merely examples embodying the present disclosure, and do not limit the technical scope of the present disclosure. For the sake of convenience in description, the vertical direction when an image forming apparatus 10 is in an installed state (a state as illustrated in FIG. 1) in which the image forming apparatus 10 is ready for use, is defined as an up-down direction 7. In addition, a front-rear direction 8 is defined such that a front side (forward side) is a side on which a sheet feed cassette of a sheet feed conveying portion 24 illustrated in FIG. 1 is inserted and pulled out when the image forming apparatus 10 is in the installed state. Moreover, a left-right direction 9 is defined on the basis of the front side of the image forming apparatus 10 in the installed state.

The image forming apparatus 10 according to an embodiment of the present disclosure is an apparatus having at least a printing function. The image forming apparatus 10 is a so-called tandem-type color printer.

Figure 2:
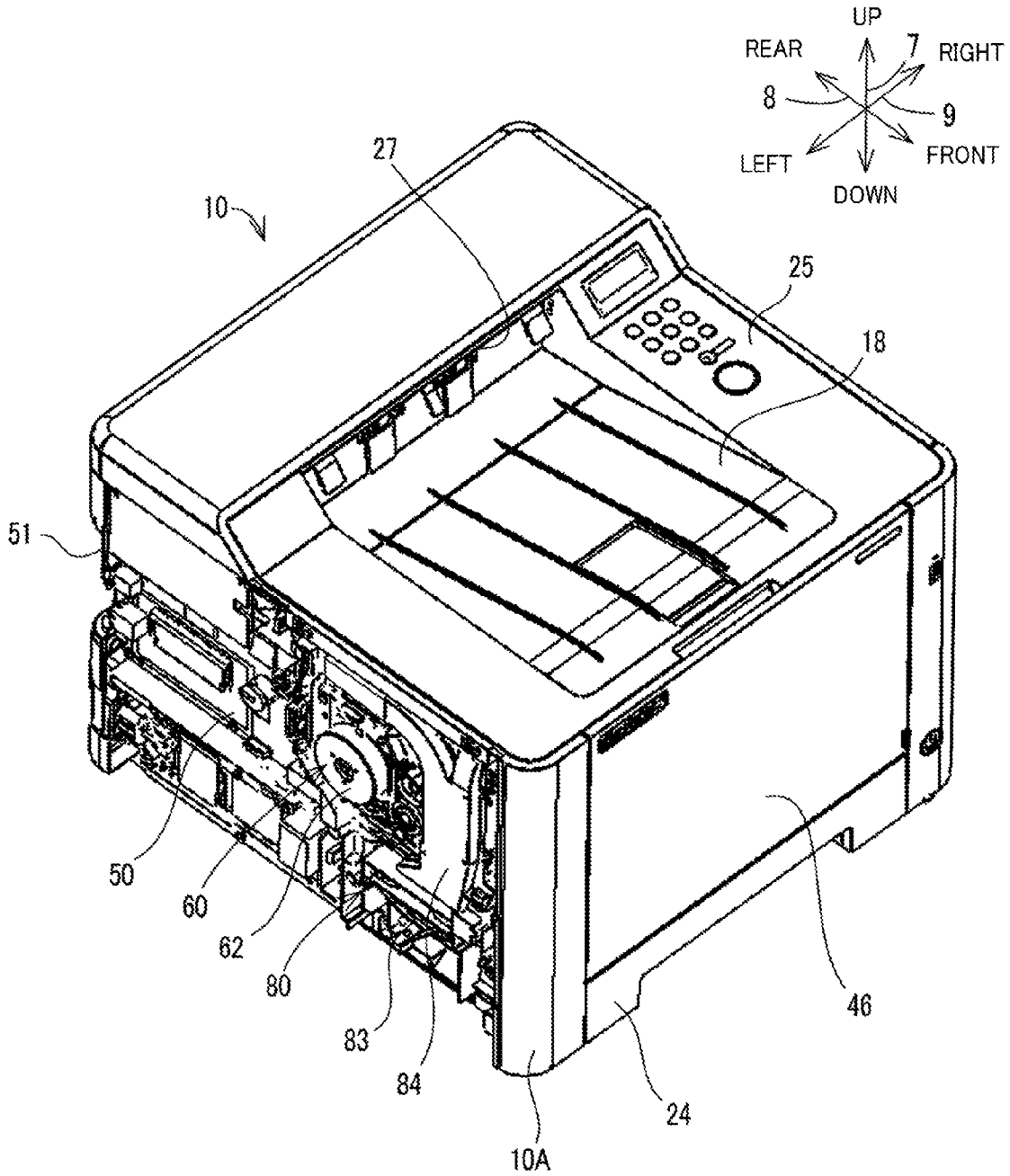
FIG. 2 is a perspective view illustrating the image forming apparatus with a cover panel at the left side surface of the image forming apparatus removed therefrom.

As illustrated in FIGS. 1 and 2, the image forming apparatus 10 includes a housing 10A. The housing 10A as a whole is substantially in the shape of a rectangular parallelepiped. Various portions of the image forming apparatus 10 are contained in the housing 10A. FIG. 2 illustrates the image forming apparatus 10 when a cover panel 10B (see FIG. 1) forming a left side surface of the housing 10A is removed therefrom.

The image forming apparatus 10 includes four image forming units 4, an intermediate transfer belt 5, a laser scanning unit 13, a secondary transfer roller (not shown), a fixing device 16, a sheet tray 18, the sheet feed conveying portion 24, an operation display portion (not shown), a vertical conveying path 26, a belt cleaning device 6, a main control board 2, and the like.

Figure 4:
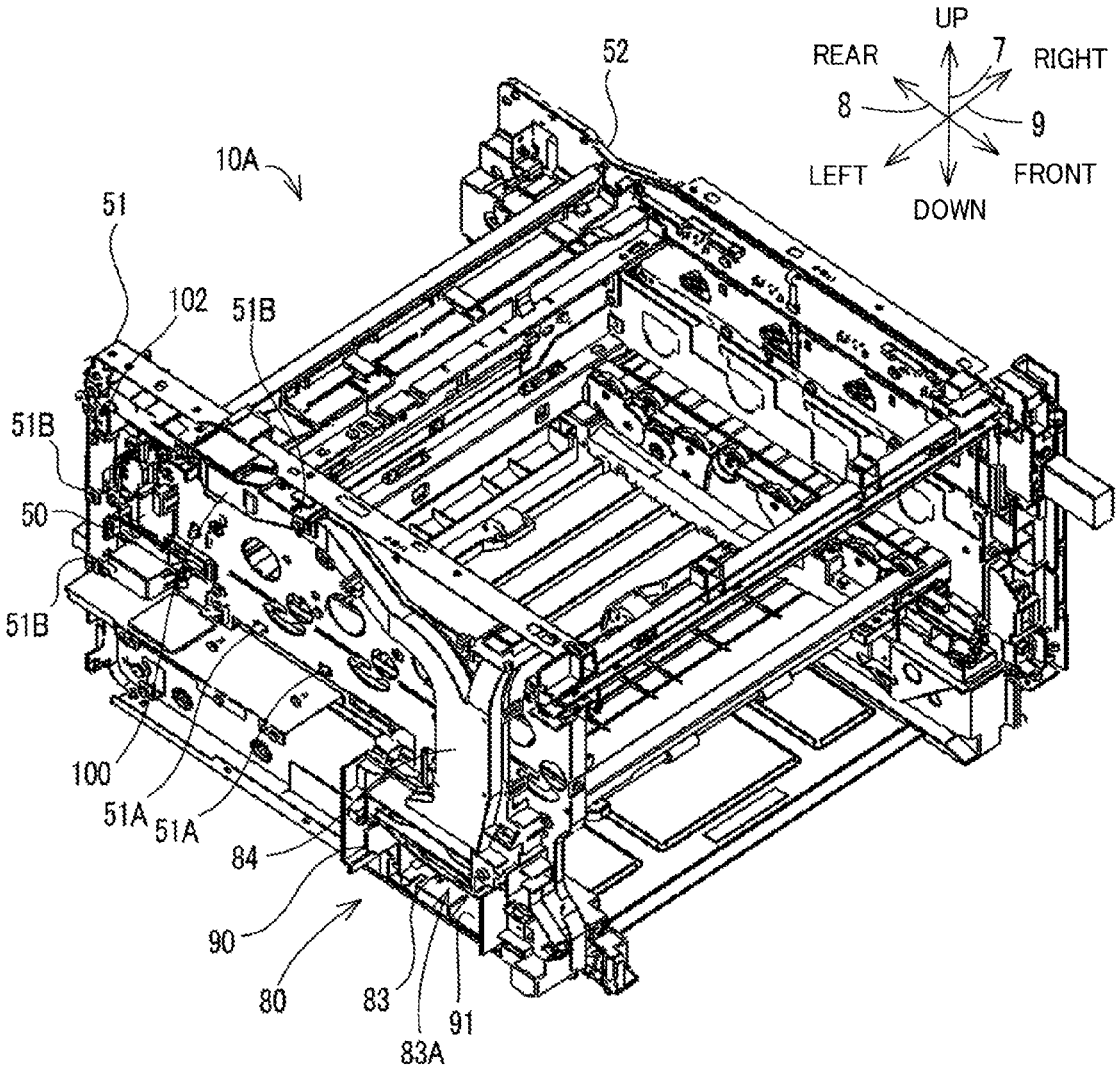
FIG. 4 is a perspective view illustrating a housing of the image forming apparatus.

As illustrated in FIG. 4, the housing 10A includes a pair of side frames 51 and 52, each of which extends in the up-down direction 7. The side frame 51 is provided at the left side of the housing 10A, and the side frame 52 is provided at the right side of the housing 10A. The side frame 51 is an example of a support plate according to the present disclosure. Each of the side frames 51 and 52 is a plate-shaped member extending in the vertical direction, and is formed by a sheet metal. A duct member 100 and a secondary control board 50, which will be described below, are attached to the side frame 51. In addition, various components, such as the image forming units 4, the intermediate transfer belt 5, the belt cleaning device 6, and the main control board 2, are provided in a space between the side frames 51 and 52.

The intermediate transfer belt 5 is provided above the four image forming units 4. The belt cleaning device 6 is provided above the intermediate transfer belt 5 and at a rearward position in the housing 10A.

Figure 3:
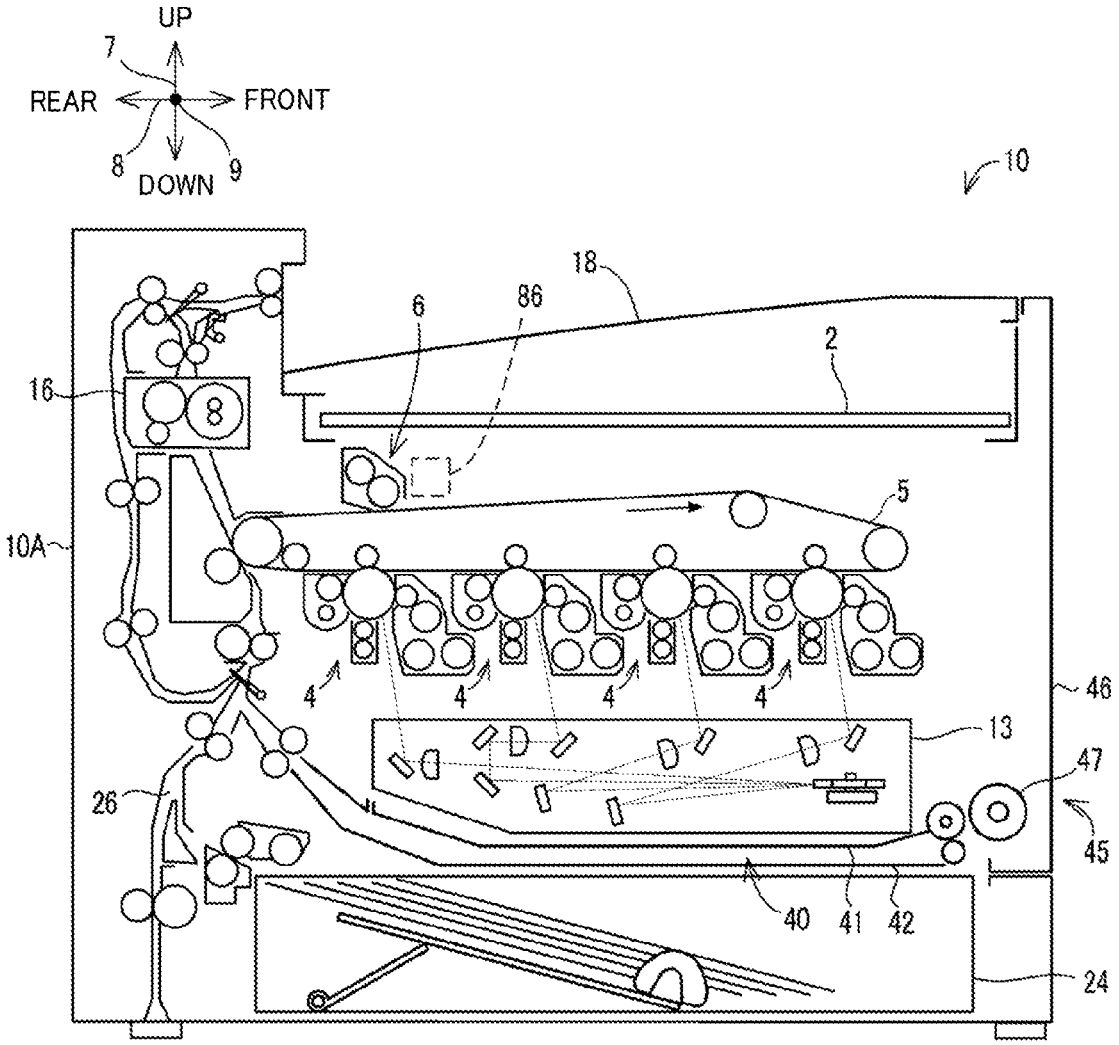
FIG. 3 is a sectional view illustrating the internal structure of the image forming apparatus.

A manual sheet feed portion 45 is provided at a front surface side of the image forming apparatus 10. The sheet feed portion 45 feeds a print sheet to the secondary transfer roller (not shown) via a conveying path 40 and the vertical conveying path 26 in the image forming apparatus 10. The sheet feed portion 45 includes a sheet receiving portion 46 and a feeding portion 47. The sheet receiving portion 46 serves also as a front cover of the housing 10A of the image forming apparatus 10. The sheet receiving portion 46 is configured to be capable of opening and closing an entrance of the conveying path 40 with respect to the front surface of the housing 10A. FIG. 3 illustrates a state in which the sheet receiving portion 46 is closed with respect to the front surface of the housing 10A. If the sheet receiving portion 46 is opened with respect to the front surface of the housing 10A, so that an inner surface of the sheet receiving portion 46 faces upward, print sheets having a predetermined size can be placed on the inner surface. The print sheets placed on the sheet receiving portion 46 are fed to the conveying path 40 by the feeding portion 47. A pair of conveying rollers (not shown) are provided at the conveying path 40, and each print sheet is conveyed rearward along the conveying path 40 by the pair of conveying rollers.

An open/close sensor (not shown) is provided at front surface side in the image forming apparatus 10. The open/close sensor detects whether the sheet receiving portion 46 is opened or closed, and is formed by, for example, a mechanical switch such as a limit switch, an optical sensor, or the like. The open/close sensor and the secondary control board 50 are electrically connected with each other via a signal line. If the sheet receiving portion 46 is opened with respect to the housing 10A, an OFF signal is outputted from the open/close sensor, whereas if the sheet receiving portion 46 is closed, an ON signal is outputted from the open/close sensor.

As illustrated in FIG. 3, the main control board 2 is provided above the intermediate transfer belt 5. In more detail, the main control board 2 is provided between the sheet tray 18 and the intermediate transfer belt 5. The sheet tray 18 forms an upper surface of the image forming apparatus 10, and holds a discharged sheet on which an image has been formed. The main control board 2 controls various portions of the image forming apparatus 10. The main control board 2 is a plate-shaped board on which electronic devices, such as an computing device including a CPU, a ROM, and the like, an electrolytic capacitor, a coil, a converter (e.g., an AC/DC converter), and a transformer that steps up or down a voltage, are mounted. The main control board 2 is connected to each image forming unit 4, the secondary transfer roller (not shown), the fixing device 16, the driving roller (not shown), the sheet feed conveying portion 24, and the like, and controls these components. If the main control board 2 is energized, each electronic device generates heat to be a heat source. In addition, if the main control board 2 is excessively heated by heat from the fixing device 16, the main control board 2 may malfunction. Thus, the main control board 2 needs to be cooled.

As illustrated in FIG. 2, the image forming apparatus 10 further includes the secondary control board 50, a driving unit 60, and a cooling device 80. The secondary control board 50, the driving unit 60, and the cooling device 80 are provided on the side frame 51.

Figure 5:
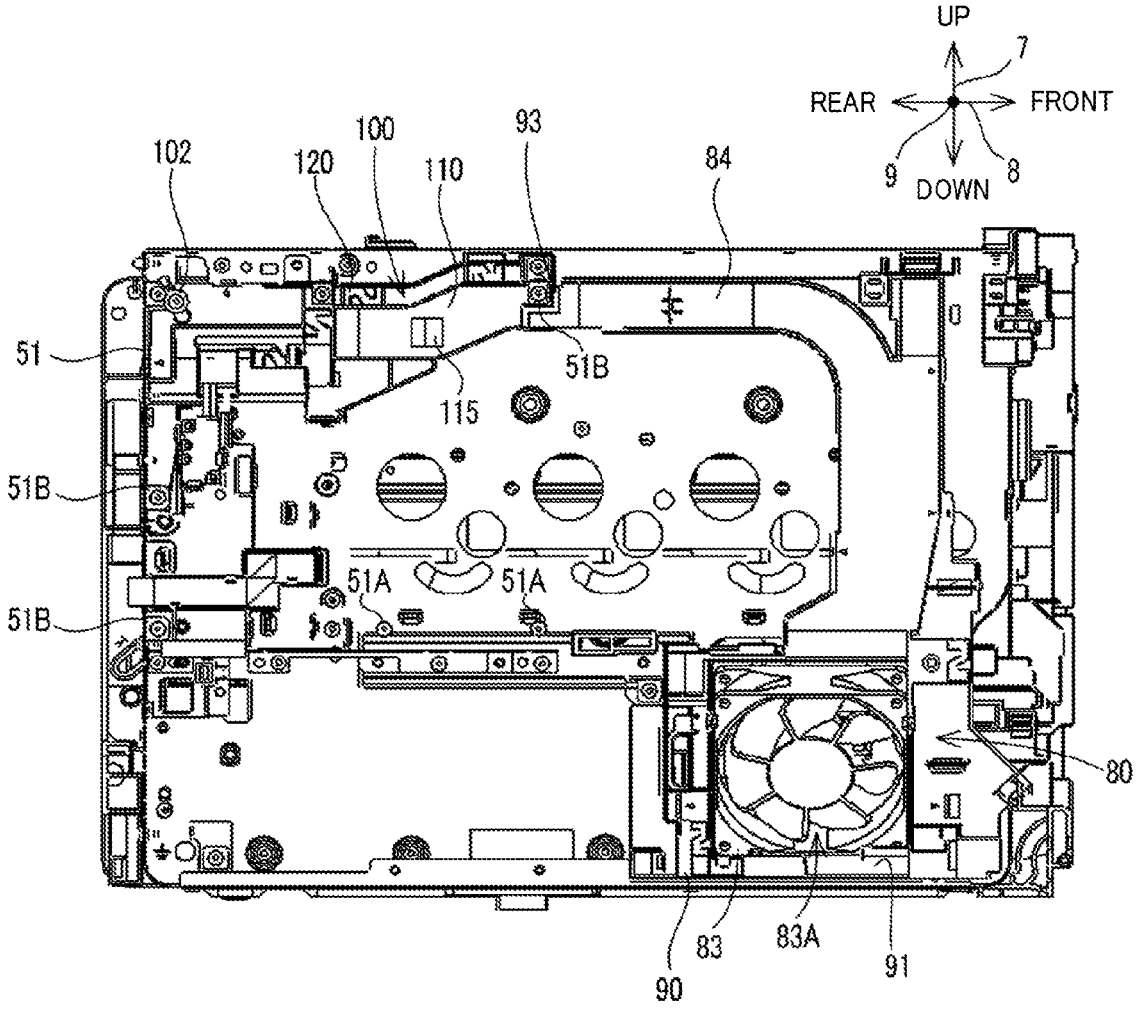
FIG. 5 is a side view illustrating the structure of a left side frame of the image forming apparatus.
Figure 6:
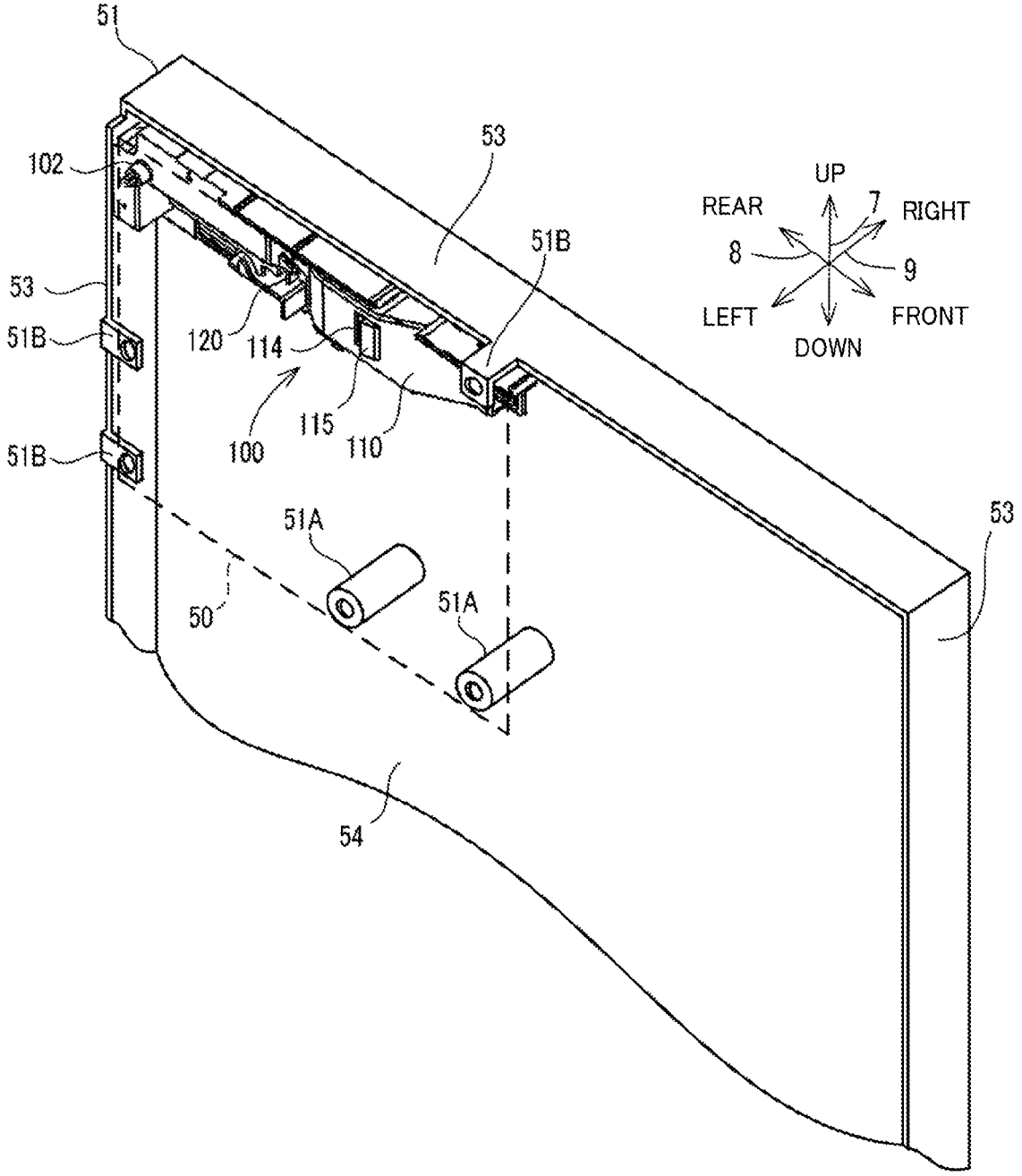
FIG. 6 is a perspective view schematically illustrating the structure of the left side frame of the image forming apparatus.

As illustrated in FIGS. 5 and 6, the side frame 51 is formed by subjecting the sheet metal to a bending process. The side frame 51 is substantially rectangular, and extends in both the up-down direction 7 and the front-rear direction 8 (a horizontal direction). The side frame 51 includes a rectangular bottom plate 54, and a side wall 53 extending perpendicularly from an outer peripheral end of the bottom plate 54. The side wall 53 extends to the left from the bottom plate 54 in FIG. 6.

Figure 8:
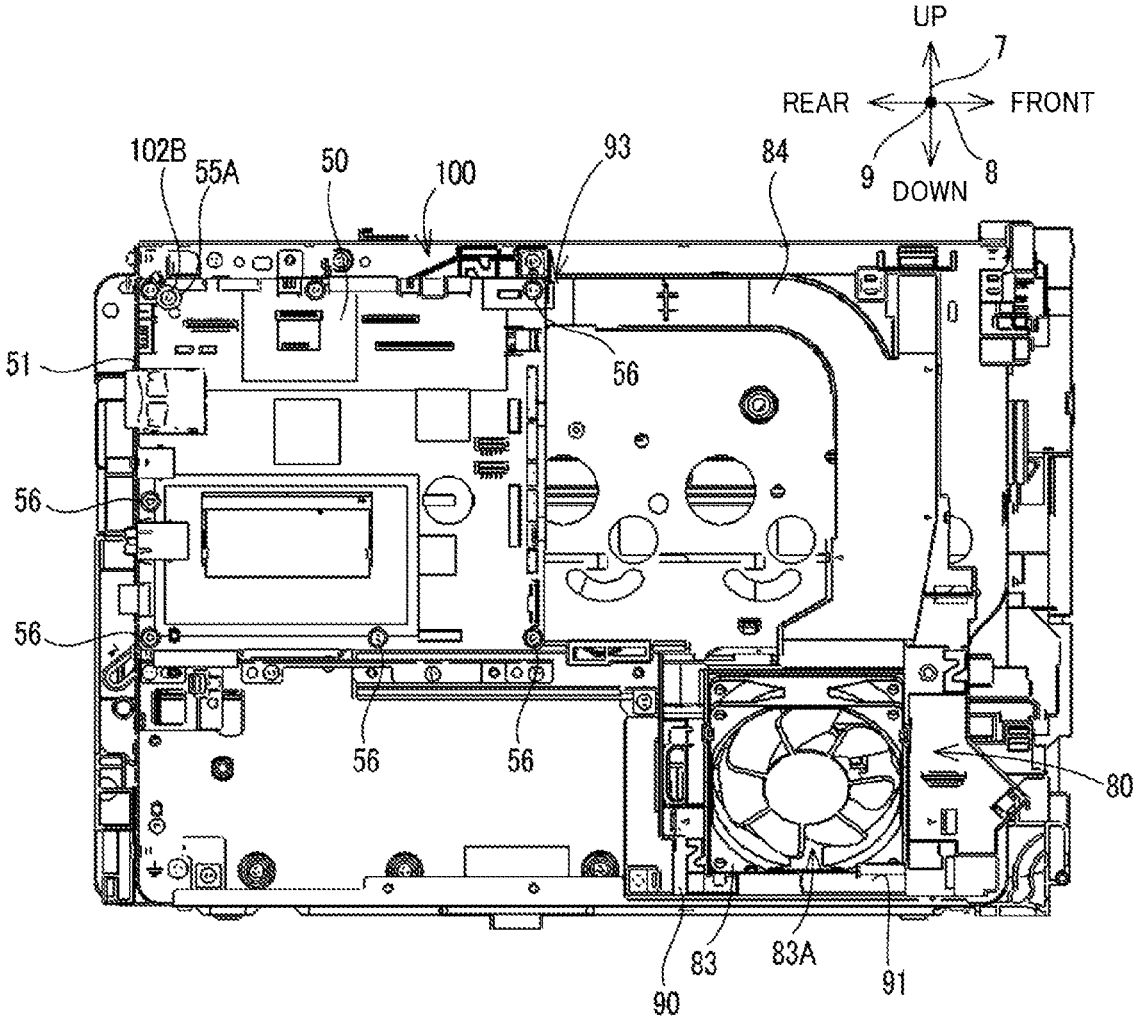
FIG. 8 is a side view illustrating the structure of the left side frame of the image forming apparatus.
Figure 9:
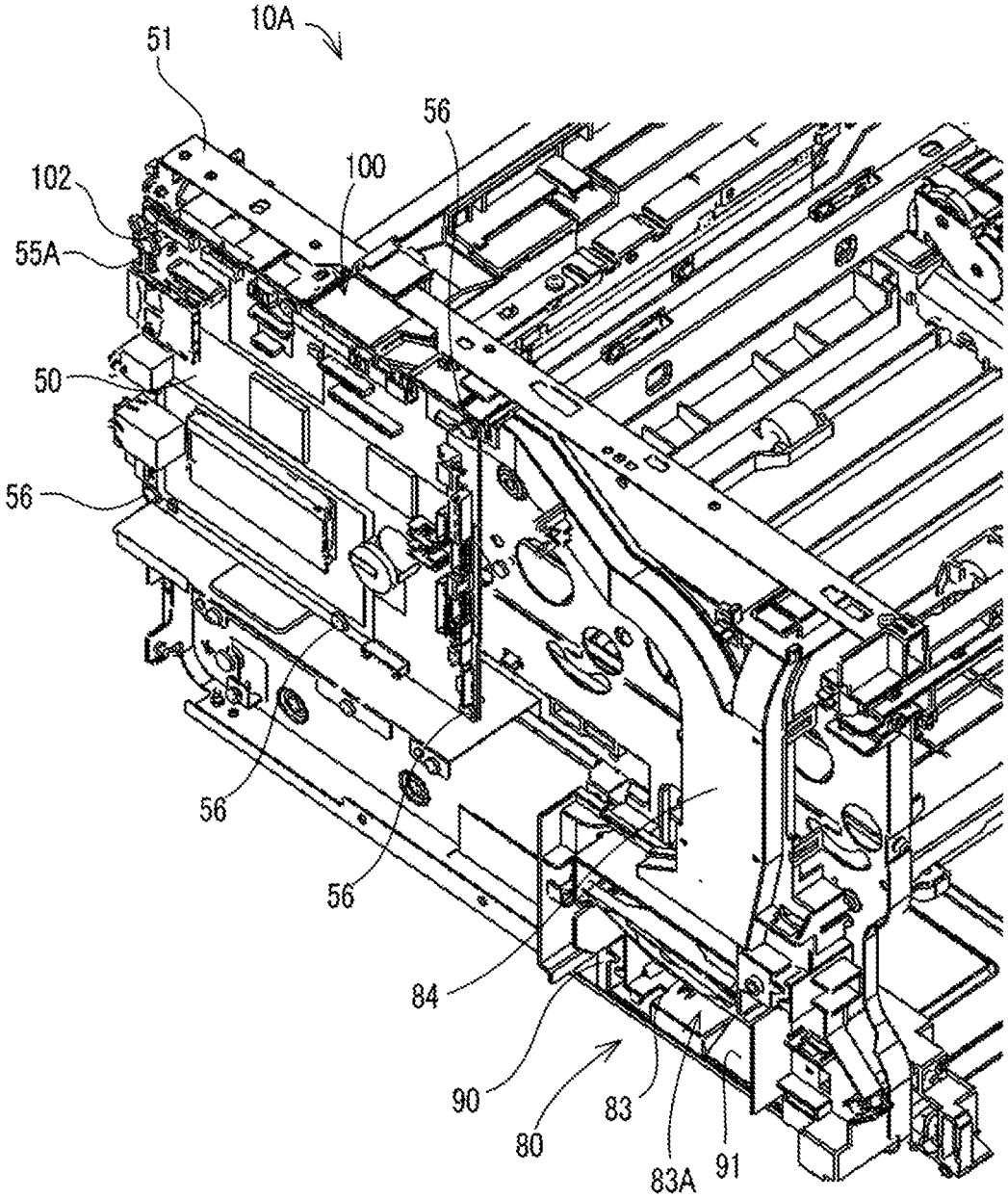
FIG. 9 is a perspective view illustrating the structure of the left side frame of the image forming apparatus.

As illustrated in FIGS. 8 and 9, the secondary control board 50 is attached to the side frame 51. In more detail, the secondary control board 50 is attached at an upper rear position on the left side of the side frame 51. The side frame 51 is provided with bosses 51A and brackets 51B (see FIG. 6) for fixing the secondary control board 50. Each of the bosses 51A and the brackets 51B is an example of a fixing portion according to the present disclosure. The two bosses 51A are used to fix a lower end portion of the secondary control board 50, and are attached to the bottom plate 54 through welding or the like. Each of the three brackets 51B projects from the side wall 53 in a direction parallel to the bottom plate 54. A screw hole is formed in each of the bosses 51A and the brackets 51B. In addition, the duct member 100, which will be described below, is attached to the side frame 51. In the present embodiment, the secondary control board 50 is attached to the bottom plate 54 of the side frame 51 through the duct member 100, the bosses 51A, and the brackets 51B.

The secondary control board 50 converts a commercial voltage to a control voltage and a drive voltage used in the image forming apparatus 10, and supplies the control voltage and the drive voltage to various portions of the image forming apparatus 10, and receives a signal transmitted through the signal line in accordance with an opening or closing of the sheet receiving portion 46, and determines whether the sheet receiving portion 46 is opened or closed. The secondary control board 50 is a board on which electronic devices, such as an computing device including a CPU, a ROM, and like, an electrolytic capacitor, a coil, a converter (e.g., an AC/DC converter), and a transformer that steps up or down a voltage, are mounted. Accordingly, if the secondary control board 50 is energized, each electronic device generates heat to be a heat source, and the secondary control board 50 therefore needs to be cooled.

As illustrated in FIG. 2, the driving unit 60 and the cooling device 80 are attached to the side frame 51.

The driving unit 60 includes a motor 62, a drive transmission mechanism such as a gear, and like. The driving unit 60 is attached to a central portion of the side frame 51 through a bracket (not shown) using screws or the like. An output shaft of the motor 62 extends to an opposite side of the side frame 51 through a through opening (not shown) formed in the side frame 51. The drive transmission mechanism is connected to the output shaft. The drive transmission mechanism transmits a rotational driving force of the motor 62 to portions to be driven, such as a developing roller and a photosensitive drum of each image forming unit 4, and a driving roller for driving the intermediate transfer belt 5. An electromagnetic clutch or the like is provided between the drive transmission mechanism and each portion to be driven, and the electromagnetic clutch or the like is controlled as appropriate to control drive transmission to each portion to be driven.

As illustrated in FIGS. 4 and 5, the cooling device 80 is attached to the side frame 51. Note that each of FIGS. 4 and 5 illustrates the side frame 51 with the secondary control board 50 removed therefrom. The cooling device 80 includes a resin frame 81, a blower fan 83 (an example of a blower according to the present disclosure), an air duct 84 (an example of a second air duct according to the present disclosure), and the duct member 100. Each of the air duct 84 and the duct member 100 guides air sent by the blower fan 83.

When the blower fan 83 is driven, the blower fan 83 sucks air through a suction port 83A and blows the air out through an outlet port, thus sending the air. The blower fan 83 is, for example, an axial fan. Needless to say, a blower of a type different from the axial fan may alternatively be used as the blower fan 83. The blower fan 83 is attached to the side frame 51 through the resin frame 81. In the present embodiment, the blower fan 83 is attached at a lower front position on the side frame 51.

The resin frame 81 is obtained by molding a synthetic resin. The resin frame 81 includes a substantially rectangular fan-mounting portion 90. A mounting seat 91 is provided in the fan-mounting portion 90, and the blower fan 83 is mounted on the mounting seat 91. A lower end of the mounting seat 91 is positioned to the right (i.e., to the far side of the drawing sheet in FIG. 5) relative to an upper end of the mounting seat 91. Thus, when the blower fan 83 is mounted on the mounting seat 91, the air blown by the blower fan 83 is sent obliquely upward.

The air duct 84 is formed integrally with the resin frame 81. The air duct 84 extends upward from an upper portion of the mounting seat 91, and then bends toward the rear of the housing 10A (i.e., to the left of the drawing sheet in FIG. 5) to extend in the horizontal direction. An extending end of the air duct 84 reaches a position near the middle of the side frame 51. The extending end of the air duct 84 is not closed, and forms an opening 93 facing rearward. The opening 93 and an air inlet 111 of an air duct 110, which will be described below, are connected to each other. The air duct 84 is rectangular in cross section, and is formed integrally with the resin frame 81. An air inlet of the air duct 84 is connected to the outlet port of the blower fan 83. Thus, the air blown by the blower fan 83 is guided to the opening 93 through the air duct 84.

In the cooling device 80, the blower fan 83 is driven constantly or at required timing. Since the cooling device 80 is for cooling the image forming units 4, the belt cleaning device 6, the main control board 2, the secondary control board 50, and like, the cooling device 80 is controlled to be driven, for example, during a period when there is concern for an increase in the temperature of each of these components, specifically, during a period from a start of image formation to an end of the image formation, or during a period from a start of image formation to a predetermined time after an end of the image formation.

As illustrated in FIGS. 5 and 6, the duct member 100, which is connected to the opening 93 of the air duct 84, is provided on the side frame 51. The duct member 100 is attached at an upper rear position on the side frame 51. The duct member 100 extends rearward from the opening 93. The duct member 100 includes the air duct 110, which will be described below, and the air duct 110 is connected to the opening 93 of the air duct 84.

Here, in the case where the duct member 100 is attached to the side frame 51, if the duct member 100 is disposed adjacent to the secondary control board 50 in the side frame 51, a space for attaching the duct member 100 needs to be secured in the side frame 51. In this case, the side frame 51 should increase in size, which in turn leads to an increase in the size of the image forming apparatus 10. Further, it may be difficult to dispose the duct member 100 so as to allow efficient sending of air because of an interruption of the secondary control board 50 or another member attached to the side frame 51, which may lead to a failure to supply a sufficient volume of air to cool the heat sources. In contrast, the image forming apparatus 10 according to the present embodiment is able to achieve a sufficient volume of the duct member 100 while reducing the space for disposing the duct member 100.

A communicating opening 86 (see FIGS. 11A and 11B) is formed in a surface, of the bottom plate 54 of the side frame 51, on which the duct member 100 is attached. In a state in which the duct member 100 is attached to the bottom plate 54, the communicating opening 86 brings an interior of the air duct 110 and a space on the opposite side of the side frame 51 into communication with each other. In the present embodiment, the communicating opening 86 is formed at a position substantially coinciding with the position of the belt cleaning device 6 in both the up-down direction 7 and the front-rear direction 8, more specifically, at a position slightly forward of the position of the belt cleaning device 6. The duct member 100 guides air sent from the blower fan 83 through the air duct 84 to the communicating opening 86 through the air duct 110, and guides the air from the communicating opening 86 to the space on the opposite side of the side frame 51. In more detail, when the blower fan 83 is driven, air in a space to the left of the side frame 51 in the housing 10A is sucked, and the air then passes through the air duct 84, the air duct 110, and the communicating opening 86 to be blown into the space to the right of the side frame 51.

Figure 7A:
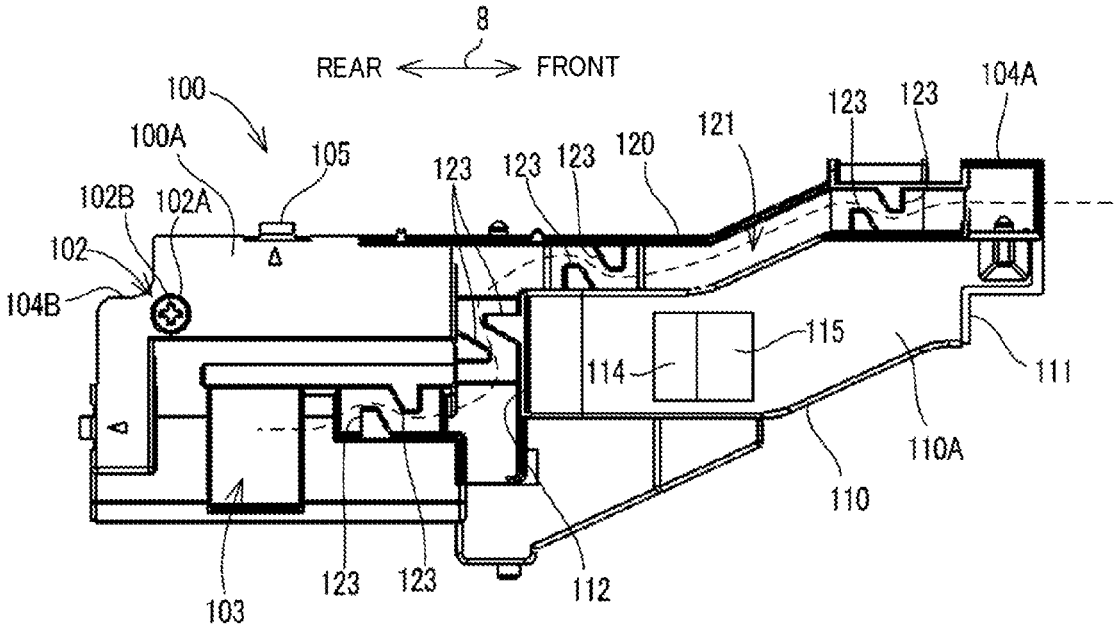
FIGS. 7A and 7B each illustrate the structure of an air duct.
Figure 7B:
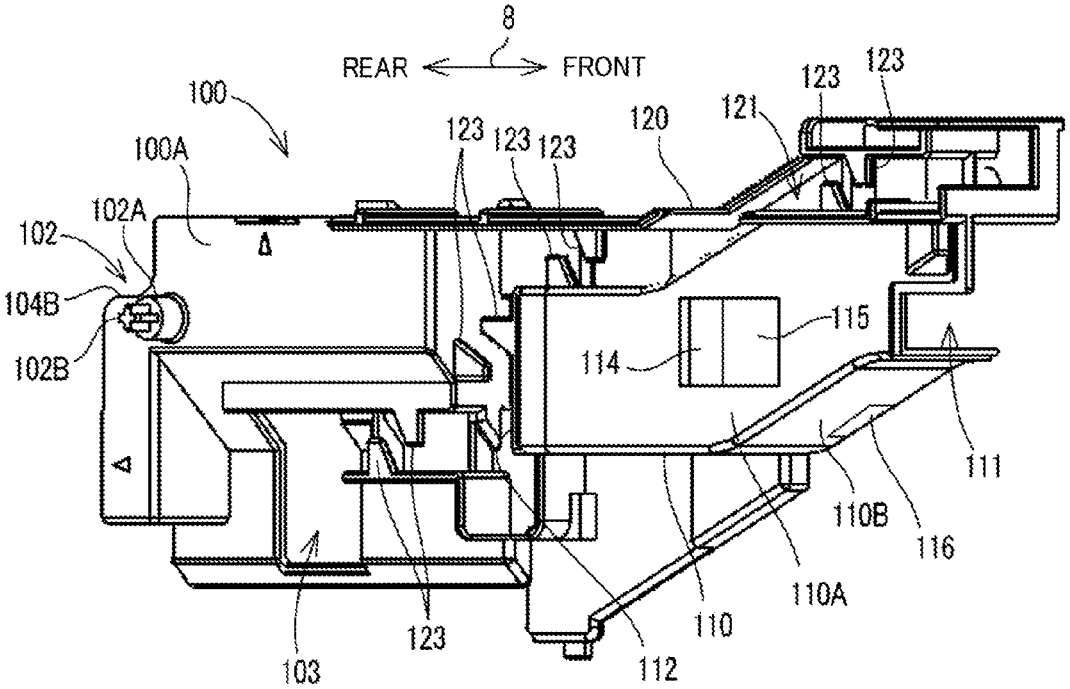

As illustrated in FIGS. 7A and 7B, the duct member 100 includes the air duct 110 (an example of a first air duct according to the present disclosure) and a wire holding portion 120. The duct member 100 is obtained by molding a synthetic resin, and the air duct 110 and the wire holding portion 120 are formed integrally with each other. The duct member 100 is elongated in one direction, and is attached to the side frame 51 such that the longitudinal direction of the duct member 100 (i.e., the left-right direction on the drawing sheet in FIGS. 7A and 7B) coincides with the front-rear direction 8 of the housing 10A.

The air duct 110 is connected to the opening 93 of the air duct 84, and guides the air sent from the air duct 84, toward the rear of the housing 10A. The air duct 110 extends from the air inlet 111, which is formed at a front end portion 104A of the duct member 100, to a position near the middle of the duct member 100. In other words, a terminal end portion 112 of the air duct 110 is positioned near the middle of the duct member 100. The air duct 110 is rectangular in cross section.

At a rear end portion 104B on the other side of the duct member 100, a positioning boss 102 (an example of a boss portion according to the present disclosure) projecting perpendicularly from an outer surface 100A of the duct member 100 is formed. The positioning boss 102 includes a spacer portion 102A and a cross projection 102B. The spacer portion 102A is columnar, and has an outer diameter greater than that of a positioning hole 55A formed in the secondary control board 50. The cross projection 102B is formed at a projecting end of the spacer portion 102A, and has such an outer diameter that the cross projection 102B can be inserted through the positioning hole 55A.

In addition, the duct member 100 includes a recessed portion 100B, which is recessed from the outer surface 100A. The recessed portion 100B is formed at a lower portion of the rear end portion 104B of the duct member 100. The recessed portion 100B includes an opening 103 formed therein.

The wire holding portion 120 holds a wire, such as the signal line electrically connected to the secondary control board 50. The wire holding portion 120 is adjacent to the air duct 110 and is formed integrally in the duct member 100. The wire holding portion 120 includes a holding groove 121 formed in the outer surface 100A of the duct member 100. The wire is inserted in the holding groove 121, and the wire is thus held in the holding groove 121. The holding groove 121 is formed in such a shape as to extend from the front end portion 104A rearward above the air duct 110, then bend downward along the terminal end portion 112, and further bend rearward. A terminal end of the holding groove 121 reaches the recessed portion 100B. In other words, the holding groove 121 communicates to a recessed space defined by the recessed portion 100B. Thus, the wire held in the holding groove 121 can be guided to the recessed portion 100B, and in the recessed portion 100B, the wire can be guided to a back side of the duct member 100 through the opening 103.

In addition, engagement projections 123 which project so as to be opposed to each other are formed in an inner wall of the holding groove 121. The wire held in the holding groove 121 is thus securely held by the engagement projections 123.

In addition, the duct member 100 includes an engagement piece 105 to fix the duct member 100 to the bottom plate 54 of the side frame 51. The engagement piece 105 projects from an upper portion of the duct member 100 toward the bottom plate 54. An engagement hole (not shown) is formed in the bottom plate 54. The engagement piece 105 is inserted through the engagement hole, to be engaged therewith through snap fitting. The duct member 100 is thus fixed to the bottom plate 54. Note that the mechanism of attachment between the duct member 100 and the side frame 51 is not limited to the above snap fitting, but a fixing member such as a screw may be used.

Figure 10:
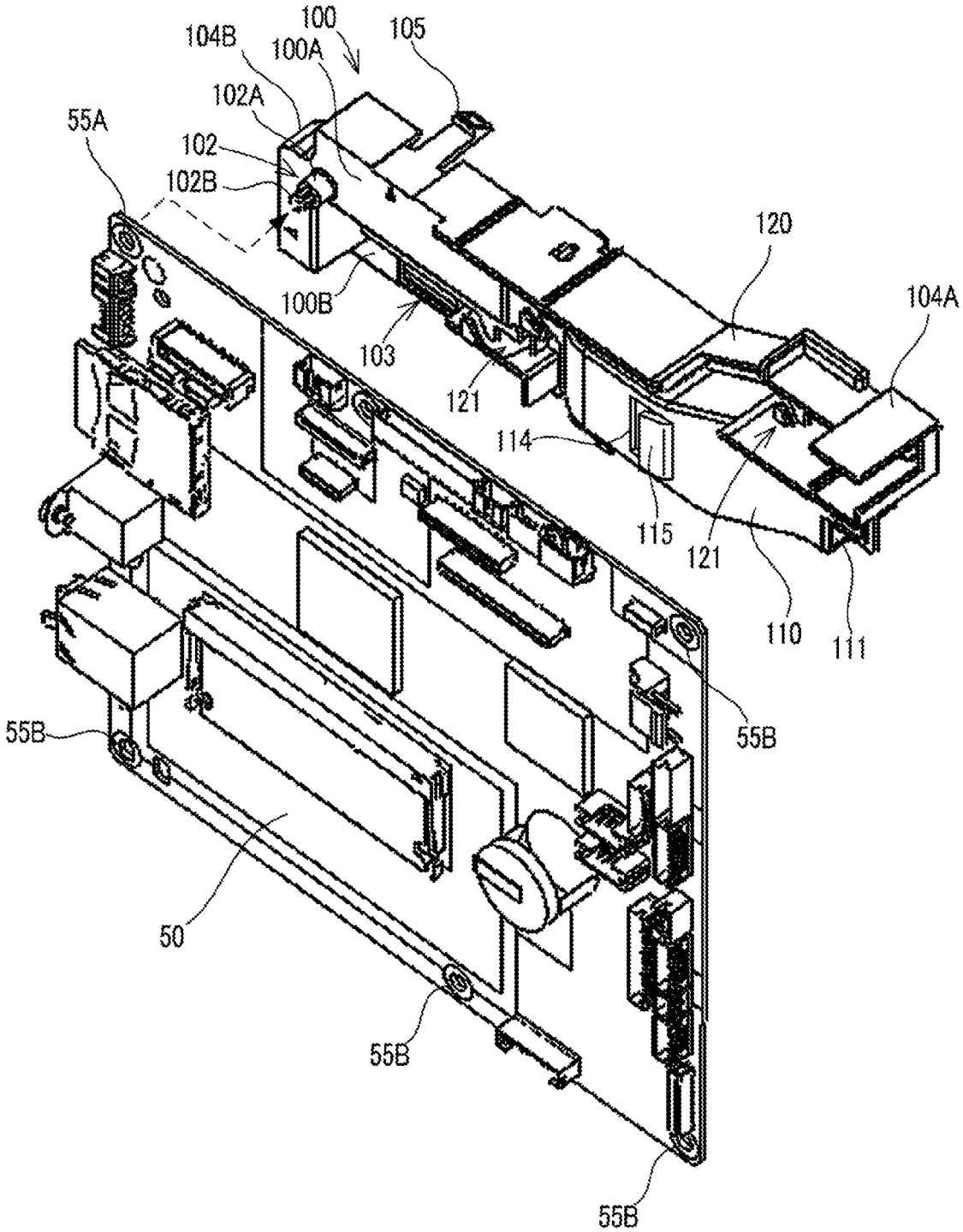
FIG. 10 is a perspective view illustrating the positional relationship between a board and the air duct.

In the present embodiment, in a state in which the duct member 100 is attached to the side frame 51, the secondary control board 50 is attached to the side frame 51 so as to cover an outer surface 110A of the duct member 100. Specifically, the positioning hole 55A is formed in an upper rear end portion of the secondary control board 50. As illustrated in FIG. 10, the positioning boss 102 of the duct member 100 is inserted through the positioning hole 55A of the secondary control board 50. At this time, the spacer portion 102A comes into contact with the secondary control board 50, and therefore only the cross projection 102B passes through the positioning hole 55A. As a result, the secondary control board 50 is positioned with respect to the side frame 51.

A plurality of attachment holes 55B (see FIG. 10) are formed in the secondary control board 50 at positions corresponding to those of the bosses 51A and the brackets 51B of the side frame 51. In a state in which the positioning boss 102 is inserted through the positioning hole 55A of the secondary control board 50, each attachment hole 55B is aligned with the corresponding boss 51A or bracket 51B, and then these are fixed to each other by a fixing tool such as a screw 56 (see FIG. 8). As a result, the secondary control board 50 is attached to the side frame 51 with an upper portion of the secondary control board 50 covering the outer surface 110A of the duct member 100. Each of FIGS. 8 and 9 illustrates the secondary control board 50 attached to the side frame 51.

In addition, a first air outlet 114 is formed in the outer surface 110A of the air duct 110. The first air outlet 114 is a through hole formed in the outer surface 110A. If air is sent from the blower fan 83 into the air duct 110, the air is blown out through the first air outlet 114 to flow into a gap between the secondary control board 50 and the air duct 110. The first air outlet 114 is formed at a position corresponding to an element that generates the most heat on the secondary control board 50. Air is thus directly sent to the secondary control board 50 to cool the secondary control board 50.

Figure 11A:
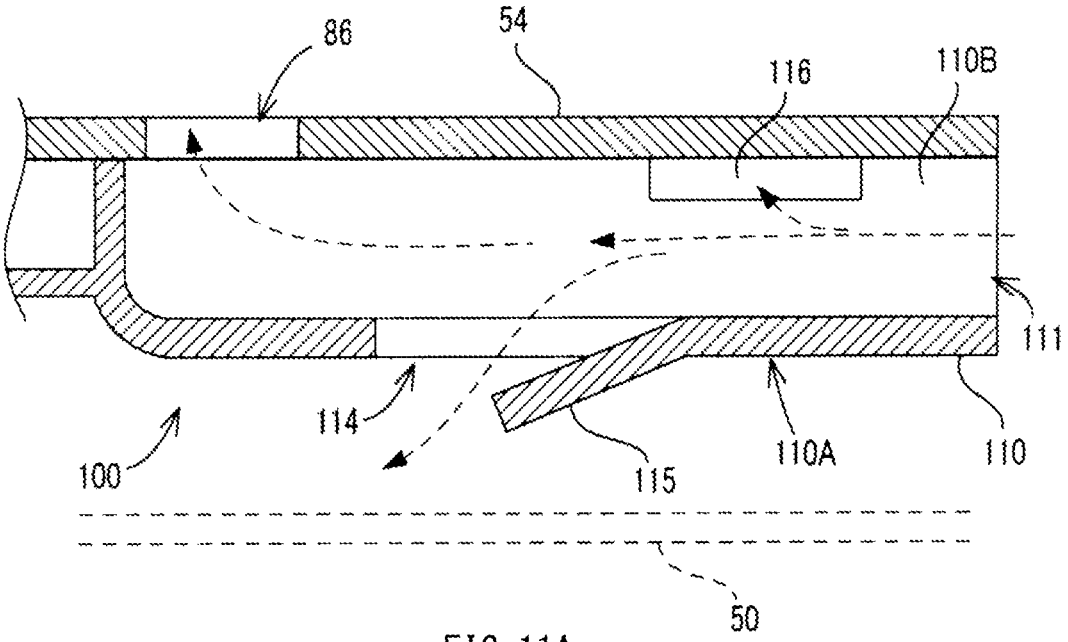
FIGS. 11A and 11B each illustrate air outlets of the air duct.

In addition, the duct member 100 includes a louver 115 (an example of an air guide according to the present disclosure) to guide air from the first air outlet 114 into the gap. As illustrated in FIG. 11A, the louver 115 extends rearward from a front edge portion of the first air outlet 114, and is formed in such a shape as to be slanted outward from the air duct 110. The air blown out through the first air outlet 114 is thus guided along the louver 115 toward a rear surface of the secondary control board 50.

Figure 11B:
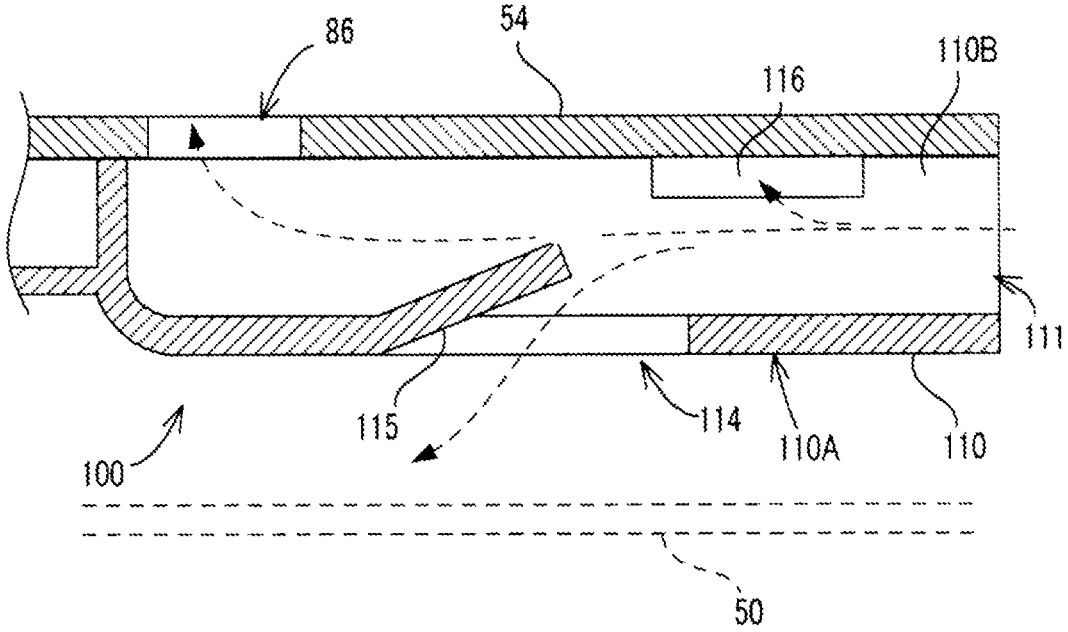

Note that the louver 115 may be shaped in any manner as long as the louver 115 is configured to guide the air from the first air outlet 114 to the gap. For example, as illustrated in FIG. 11B, the louver 115 may extend forward from a rear edge portion of the first air outlet 114, and be formed in such a shape as to be slanted to the interior of the air duct 110.

In addition, a second air outlet 116 is formed in a lower surface 110B of the air duct 110. The second air outlet 116 is a through hole formed in the lower surface 110B. If air is sent from the blower fan 83 into the air duct 110, the air is blown out through the second air outlet 116. The air is thus blown out through the second air outlet 116 to flow downward along the rear surface of the secondary control board 50. As a result, a member provided below the air duct 110 and an area around the lower end portion of the secondary control board 50 are cooled.

Here, in the case where the duct member 100 and the secondary control board 50 are separately attached to the side frame 51, the duct member 100 is attached adjacently to the secondary control board 50 on the side frame 51. In this case, a space for attaching the duct member 100 needs to be secured in the side frame 51, and this leads to an increase in the size of the side frame 51, which in turn leads to an increase in the size of the image forming apparatus 10. Further, it may be difficult to dispose the duct member 100 and the air duct 110 so as to allow efficient sending of air because of an interruption of the secondary control board 50 or another member attached to the side frame 51, which may lead to a failure to supply a sufficient volume of air to cool the heat sources.

However, as described above, in the image forming apparatus 10 according to the present embodiment, an upper end portion of the secondary control board 50 is positioned and supported by the duct member 100 so as to cover the outer surface 110A of the air duct 110. This makes it possible to reduce the space in which the air duct 110 is disposed in the side frame 51 while securing a sufficient volume of the air duct 110 without reducing the size of the air duct 110.

In addition, since the duct member 100 integrally includes the wire holding portion 120, for example, the signal line connecting the secondary control board 50 and the open/close sensor that detects whether the sheet receiving portion 46 is opened or closed can be held in the wire holding portion 120. Further, since the signal line is held in the wire holding portion 120 adjacent to the air duct 110, a signal (e.g., a voltage signal) that passes through the signal line is prevented from becoming unstable due to an influence of an ambient temperature.

In the above embodiment, the case where the upper end portion of the secondary control board 50 is positioned with respect to the duct member 100 has been shown as an example, but the present disclosure is not limited thereto. For example, the upper end portion of the secondary control board 50 may be fixed to the duct member 100 through a screw or the like.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a housing having a support plate extending in a vertical direction;

a duct member attached to the support plate and having a first air duct through which air sent by a blower passes; and a board having an element that is mounted thereon and generates heat when energized, and having a part supported by the duct member so as to cover an outer surface of the first air duct, wherein the duct member has a wire holding portion configured to hold a wire electrically connected to the board, and the wire holding portion is formed integrally in the duct member so as to be adjacent to the first air duct.

2. The image forming apparatus according to claim 1, wherein the duct member has, in the outer surface, a first air outlet through which air in the first air duct is blown out to a gap between the board and the first air duct.

3. The image forming apparatus according to claim 2, wherein the duct member has, in a lower surface of the first air duct, a second air outlet through which air in the first air duct is blown out downward along a rear surface of the board.

4. The image forming apparatus according to claim 2, wherein the duct member has an air guide to guide air from the first air outlet to the gap.

5. The image forming apparatus according to claim 4, wherein the duct member extends in a front-rear direction of the housing, and the air guide extends forward from a rear edge portion of the first air outlet, and is formed in such a shape as to be slanted inward from the outer surface of the first air duct.

6. The image forming apparatus according to claim 1, wherein the wire holding portion has a holding groove in which the wire is held, in an outer surface of the duct member.

7. The image forming apparatus according to claim 6, wherein the duct member extends in a front-rear direction of the housing, the duct member has a recessed portion having an opening and formed at a rear end portion of the duct member, and the holding groove is formed above the first air duct in the duct member and formed in such a shape as to extend rearward from a front end portion of the duct member, then bend downward at a rear end portion of the first air duct, and further bend rearward, and the holding groove has a rear end reaching the recessed portion.

8. The image forming apparatus according to claim 6, wherein the duct member extends in a front-rear direction of the housing, the duct member has a recessed portion having an opening and formed at a rear end portion of the duct member, and the holding groove is formed above the first air duct in the duct member, and in order to cool the board, formed in such a shape as to extend rearward from a front end portion of the duct member, then bend downward at a rear end portion of the first air duct, and further bend rearward, and the holding groove has a rear end reaching the recessed portion.

9. The image forming apparatus according to claim 1, wherein the support plate has a communicating opening configured to bring an interior of the first air duct and a space on an opposite side of the support plate into communication with each other in a state in which the duct member is attached to the support plate.

10. An image forming apparatus comprising:

a housing having a support plate extending in a vertical direction;

a duct member attached to the support plate and having a first air duct through which air sent by a blower passes; and a board having an element that is mounted thereon and generates heat when energized, and having a part supported by the duct member so as to cover an outer surface of the first air duct, wherein the duct member has a boss portion projecting from the outer surface in a direction perpendicular to the support plate, and the board has a positioning hole through which the boss portion is inserted to position the board with respect to the duct member.

11. The image forming apparatus according to claim 10, wherein the duct member is attached to the support plate so as to extend in a horizontal direction, the positioning hole is formed in an upper end portion of the board, the support plate has a fixing portion to support and fix a lower end portion of the board, and the lower end portion of the board is fixed to the fixing portion by a predetermined fixing tool in a state in which the positioning hole is fitted to the boss portion.

12. The image forming apparatus according to claim 1, further comprising:

a blower attached to the support plate; and a second air duct extending from an outlet port of the blower and connected to the first air duct.

13. An image forming apparatus comprising:

a housing having a support plate extending in a vertical direction;

a duct member attached to the support plate and having a first air duct through which air sent by a blower passes; and a board having an element that is mounted thereon and generates heat when energized, and having a part supported by the duct member so as to cover an outer surface of the first air duct, wherein the duct member has a wire holding portion configured to hold a wire electrically connected to the board, the wire holding portion is formed integrally in the duct member so as to be adjacent to the first air duct, the duct member has a boss portion projecting from the outer surface in a direction perpendicular to the support plate, and the board has a positioning hole through which the boss portion is inserted to position the board with respect to the duct member.

* * * * *